United States Patent [19]

Stephens et al.

[11] 4,452,431

[45] Jun. 5, 1984

[54] RESTORABLE FENDER PANEL

[75] Inventors: Barry D. Stephens, Citrus Heights; Peter B. Morehead, Sacramento, both of Calif.

[73] Assignee: Energy Absorption Systems, Inc., Chicago, Ill.

[21] Appl. No.: 379,869

[22] Filed: May 19, 1982

[51] Int. Cl.[3] ..... A01K 3/00; E01F 15/00

[52] U.S. Cl. ..... 256/13.1; 404/6

[58] Field of Search ..... 256/13.1; 114/219; 404/6, 9; 104/254, 255, 256; 188/290, 293; 267/8 R

[56] References Cited

U.S. PATENT DOCUMENTS

| | | | |
|---|---|---|---|
| Re. 29,544 | 2/1978 | Fitch | 256/13.1 |
| 3,284,122 | 11/1966 | Rich | 293/1 |
| 3,503,600 | 3/1970 | Rich | 267/1 |
| 3,666,055 | 5/1972 | Walker et al. | 188/1 C |
| 3,672,657 | 6/1972 | Young et al. | 267/166 |
| 3,674,115 | 7/1972 | Young et al. | 256/13.1 |
| 3,680,662 | 8/1972 | Walker et al. | 188/1 B |
| 3,944,187 | 3/1976 | Walker | 256/13.1 |
| 3,982,734 | 10/1976 | Walker | 256/13.1 |
| 4,072,334 | 2/1978 | Seegmiller et al. | 293/71 R |

*Primary Examiner*—Wayne L. Shedd

*Attorney, Agent, or Firm*—Willian, Brinks, Olds, Hofer, Gilson & Lione Ltd.

[57] ABSTRACT

A self-restoring fender panel for a reusable impact attenuation device is provided. Buffer elements are positioned in an ordered array extending forwardly of a rigid backing member adjacent to a fixed structure. Diaphragm members are interposed in the array and extend laterally outward of the array at fixed intervals. Fender panels are pivotally coupled to laterally extending ends of the diaphragm members and extend rearwardly from their associated diaphragm members and partially overlap the fender panels coupled to the succeeding diaphragm members. Biasing means, such as an extension spring, interconnects each of the fender panels with the diaphragm member to which the fender panel is pivotally coupled to bias the fender panels laterally inward. Nonrigid means such as a cable connects the backing member and the diaphragm members. Preferably, the fender panels are connected to the nonrigid means by releasable clips, which may be made of wire.

7 Claims, 6 Drawing Figures

RESTORABLE FENDER PANEL

BACKGROUND OF THE INVENTION

The present invention is directed to an improvement in a device for safely protecting fixed structures from damage resulting from colliding vehicles or the like. More particularly, this invention is directed to an improved fender panel for a reusable impact attenuation device for absorbing and harmlessly dissipating the impact energy of a colliding vehicle.

It is known that rigid guardrails and similar immovable protective devices alongside vehicular traffic routes such as highspeed highways may be used for the purpose of preventing vehicles from colliding with fixed structures such as, for example, abutments, columns, and sign supports. A common practice is to place a rigid railing between the vehicular traffic route and the fixed structure to deflect the vehicle in such a manner that the vehicle avoids direct impact with the fixed structure. Such devices are of only limited value since they do not decelerate the vehicle at a controlled, safe rate to provide maximum safety and minimum injury to the occupants of the impacting vehicle. Further, such devices result in the impacting vehicle being thrown back onto the highway into the path of other moving vehicles.

It is also known that an improved and reusable impact attenuation device for protecting stationary structures from damage due to impacting vehicles can be provided utilizing an array of energy absorbing buffer elements arranged in chambers which sandwich or telescope into each other upon impact. Such chambers can be formed partially by fender panels which extend rearwardly in their normal positions to aid in properly redirecting a vehicle after a lateral impact to the protective device. U.S. Pat. Nos. 3,674,115 and 3,944,187 disclose such reusable impact attenuation devices having liquid and solid buffer elements, respectively.

Although the reusable impact attenuation devices of U.S. Pat. Nos. 3,674,115 and 3,944,187 have greatly advanced the art and have gained wide acceptance and recognition, occasional difficulties have arisen following an impact. More specifically, the fender panels may become dislodged from their normal positions by a direct impact to one of the impact attenuation devices. As a result, the fender panels as well as the support structure of the impact attenuation device may have an increased risk of damage due to wind or other causes until the impact attenuation device is serviced to restore its initial condition. Further, the dislodged fender panels may limit the ability of the impact attenuation device to function if a second impact occurs before the device is serviced.

It is known that the fender panels may be hinged to laterally extending diaphragm members and may be biased inward by springs connecting the free end of each of the fender panels to the diaphragm member adjacent the free end of the fender panel. However, such springs may permit the fender panels to flap in response to a strong gust of wind. Further, such springs may be stretched beyond their elastic limits during a severe impact and may have a reduced biasing effect when the distance between the diaphragm members is foreshortened as the chambers telescope. A need exists for an improved reusable impact attenuation device in which the fender panels are held in their normal positions before an impact and are returned to their following a severe impact, even if the distance between the diaphragm members is foreshortened.

Accordingly, it is an object of this invention to provide a restorable fender panel for a reusable impact attenuation device such that the fender panel is held tightly against the overlapped adjacent fender panel until an impact and is restored to that normal position immediately following an impact, even if the chambers have telescoped during the impact.

SUMMARY OF THE INVENTION

The present invention is directed to an improvement in a reusable impact attenuation device for safely protecting fixed structures from damage resulting from colliding vehicles or the like.

According to this invention, a restorable fender panel is provided for a reusable impact attenuation device. In the present invention, buffer elements are positioned in an ordered array extending forwardly of a rigid backing member adjacent to a fixed structure. A plurality of diaphragm members are interposed in the array and extend laterally outward of the array of fixed intervals. Fender panels are pivotally coupled to opposed ends of the diaphragm members and extend rearwardly from their associated diaphragm members and partially overlap the fender panels coupled to the succeeding diaphragm members. Biasing means interconnects each of the fender panels and the diaphragm member to which the fender panel is pivotally coupled to bias the fender panels laterally inward.

Preferably, the biasing means comprises a helical extension spring joining the fender panel to the associated diaphragm member so as to form a substantially isosceles triangle. The helical spring may be mounted to the diaphragm member laterally outward of the array of buffer elements to avoid interference between the helical spring and the buffer elements. It is preferred that nonrigid means such as a cable connects the backing member and the diaphragm members and that the fender panels are connected to the nonrigid means by releasable clips. The clips, which may be made of wire, restrain flapping of the fender panels before an impact and release the fender panels during certain impacts to absorb and dissipate energy. The extension spring may be made of stainless steel to eliminate corrosion and may be easily mounted by screw eyes.

The invention, together with further objects and attendant advantages, will be best understood with reference to the following detailed description taken in conjunction with the accompanying drawings.

DETAILED DESCRIPTION OF A PREFERRED EMBODIMENT

Figure 1:
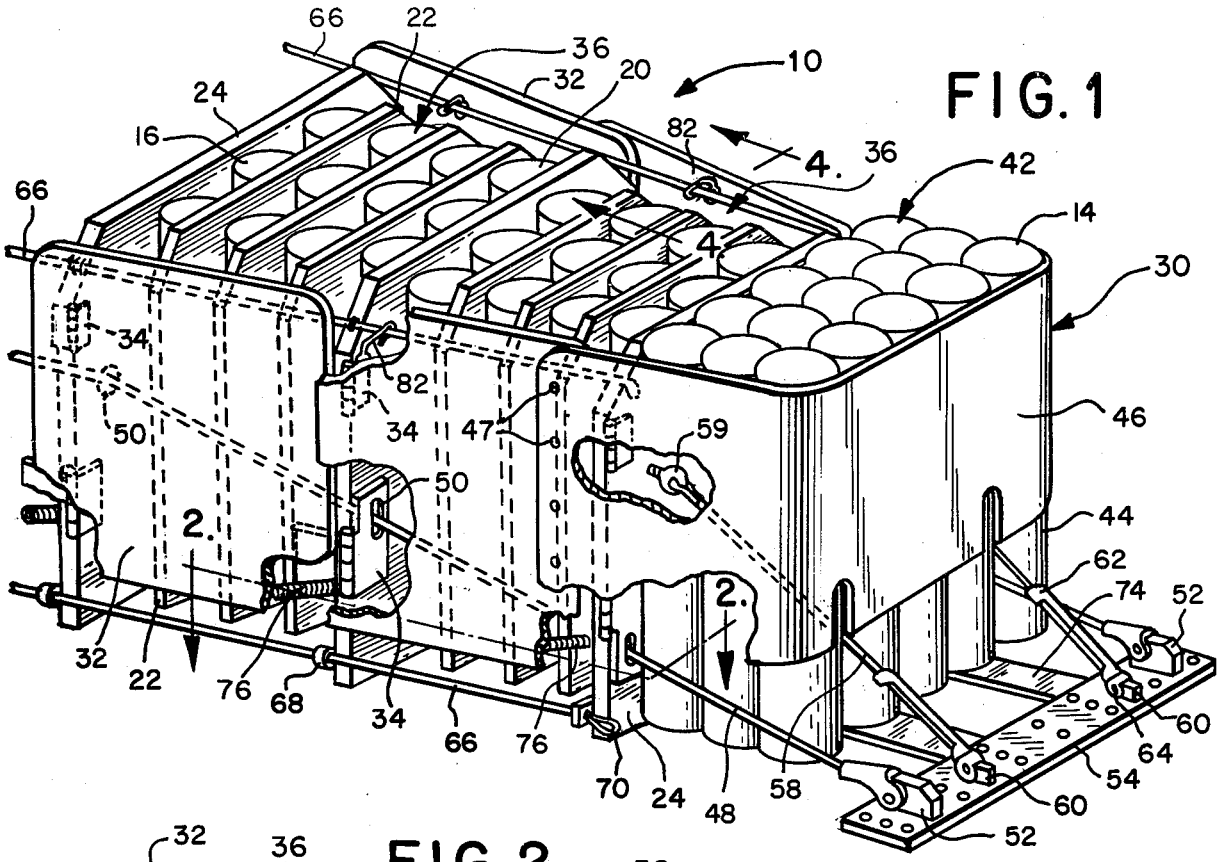
FIG. 1 is a perspective view of a portion of a first impact attenuation device having a restorable fender panel made in accordance with the present invention.

With reference to the drawings, a first impact attenuation device having restorable fender panels made in accordance with the invention is indicated generally by the numeral 10 in FIG. 1. The impact attenuation device 10 includes a rigid backing member 12, similar to that shown in FIG. 5, which is normally fixed adjacent a stationary structure to be protected near a route of vehicular traffic, such as a street or highway. The backing member 12 is provided to reinforce the stationary structure. Positioned in front of and abutting the backing member 12 is an array of buffer elements 14 which are partially filled with an incompressible fluid, preferably water.

The buffer elements 14 are collapsible cell cartridges which have the characteristic of remaining flexible and watertight in extremes of heat and cold. As an example, and not by way of limitation, the buffer elements 14 may comprise vinyl coated nylon fabric cylinders with an open upward end and a diameter of approximately 5½ inches. The length may vary as required by the installation, but lengths of 24, 30 and 36 inches have been found to be satisfactory for most installations. The base fabric of the buffer elements 14 may, for example, consist of 6.1 ounce nylon and may be coated with vinyl to produce a weight of 22 ounces per yard. This material offers a hydrostatic resistance of 300 or more pounds per square inch.

Cell inserts 16 containing sharp-edged orifices are fixed to the open ends of the buffer elements 14. Upon impact, water is controllably released from the buffer elements 14 by turbulent viscous flow through the orifices in the manner taught in U.S. Pat. No. 3,503,600 entitled "Liquid Filled Buffer For Absorbing Kinetic Energy," issued to John W. Rich. The size of the orifices is predetermined based upon speed limits, weights of vehicles, desired deceleration rates, and other factors. The buffer elements 14 are arranged in rows, indicated generally by the numeral 20, substantially parallel to the backing member 12. The rows 20 of the buffer elements 14 are mounted upon interior panels 22 and diaphragm members 24.

Toward the forward end of the device 10, indicated generally by the numeral 30, the lateral dimensions of the interior panels 22 and of the rows 20 are reduced, and the number of the buffer elements 14 in the rows 20 may be reduced correspondingly. At regularly spaced intervals, the diaphragm members 24 extend laterally beyond the associated rows 20 to provide a pivotal mounting of fender panels 32 which are attached by hinges 34 having removable pins to facilitate replacement of damaged fender panels. The fender panels 32 extend rearward from the associated diaphragm members 24 so as to enclose the interior panels 22 and the buffer elements 14 to form buffer chambers, indicated generally by the numeral 36.

Each of the buffer chambers 36 is of a lesser width than the succeeding buffer chambers 36 in a direction extending away from the backing member 12 to enhance the ability of the buffer chambers 36 to telescope one into the other upon impact. The fender panels 32 extend rearward from the associated diaphragm members 24 sufficiently to overlap portions of the fender panels 32 associated with the adjacent and rearward one of the diaphragm members 24. The most rearward of the fender panels 38 overlap the backing member 12 and may be separated therefrom by one of the buffer elements 14 to provide cushioning during a side impact to the impact attenuation device 10.

The diaphragm members 24 may be fabricated, for example, from 1½ inch thick laminated wood coated on both sides with fiber reinforced plastic. The fender panels 32 may be constructed of any suitable material such as, for example, ¾ to 1θ inch thick plywood and are, preferably, coated on both faces with fiber reinforced plastic having a low coefficient of friction. The interior panels 22 may be constructed of ½ inch thick plywood, preferably coated on both faces with an enamel paint. It is to be understood that the thickness of the interior panels 22, the diaphragm members 24, and the fender panels 32 may be varied from these dimensions depending upon the force of impact against which the impact attenuation device 10 is designed to protect.

At the forward end 30, immediately adjacent the first of the diaphragm members 24, is a forward cluster 42 of the buffer elements 14 substantially as disclosed in the previously described U.S. Pat. No. 3,503,600. Instead of being mounted upon the interior panels 22 and the diaphragm members 24, the buffer elements 14 in the forward cluster 42 are, preferably, supported by hollow, vinyl plastic cylinders 44 which are stacked together as shown in FIG. 1. The buffer elements 14 of the forward cluster 42 are enclosed by a flexible nose covering 46 which is secured to the first of the fender panels 32 by suitable fasteners such as wood screws 47. The flexible nose covering 46 may be a plastic such as vinyl and may include slots to accommodate cables, as shown in FIG. 1.

Two restraining cables 48 are securely fastened to the rigid backing member 12 and are led forward through reinforced apertures 50 in the diaphragm members 24 to mounting brackets 52 of a fixed anchor plate 54. The reinforced apertures 50 are progressively lower in the two forwardmost of the diaphragm members 24 to permit the paths for the restraining cables 48 to be in a plane, as shown in FIG. 1. The restraining cables 48 also pass along the lateral edges of the interior panels 22, which include metal reinforced side portions for contacting the restraining cables 48 to protect the interior panels 22 from excessive wear. From the third diaphragm rearward, the restraining cables 48 extend horizontally to the rigid backing member 12.

A pair of secondary cables 58 is provided between the forwardmost of the diaphragm members 24 and smaller mounting brackets 60 of the anchor plate 54. The secondary cables 58 are secured to the forwardmost diaphragm member by eyebolts 59, as shown in FIG. 1, to maintain the impact attenuation device 10 in a normal position until an impact. The secondary cables 58 are provided with turnbuckles 62 which facilitate tightening of the secondary cables 58 and with shear pins 64 which shear upon impact. Metal slide straps 72 and 74 are provided below the diaphragm members 24 along the length of the impact attenuation device 10 to ensure that the diaphragm members are readily moveable upon impact and to reduce abrasion.

Pullout cables 66 are attached to the corners of each of the diaphragm members 24 by means of cable clamps 68 provided at the four corners of each of the diaphragm members 24. A loop 70 is provided in the forward end of each of the pullout cables 66 for use in returning the impact attenuation device 10 to its original shape after an impact by applying a tension force to the loops 70. The pullout cables 66 also cooperate with the buffer elements 14 during a lateral impact to transfer the energy of impact for improved energy absorption and dissipation. The turnbuckles 62 maintain the pullout cables 66 in a taut condition until an impact to the impact attenuation device 10.

Figure 2:
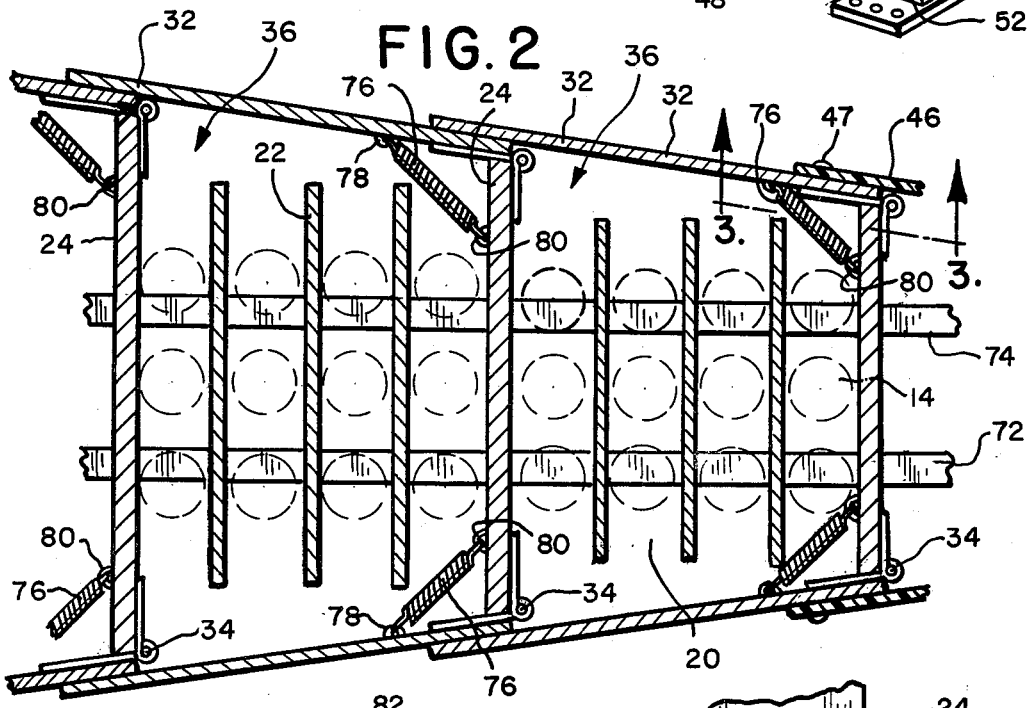
FIG. 2 is a plan view of a portion of the impact attenuation device of FIG. 1 showing two chambers of buffer elements and the associated restorable fender panels.
Figure 4:
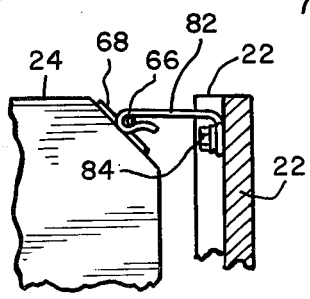
FIG. 4 is a sectional view of portions of the impact attenuation device of FIG. 1 taken along the line 4—4 of FIG. 1.
Figure 3:
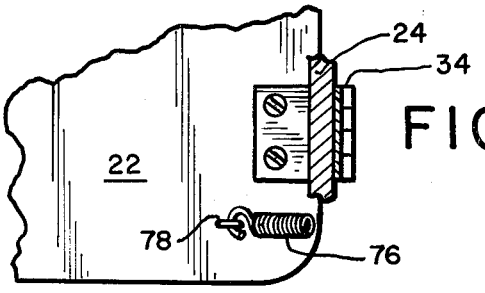
FIG. 3 is an enlarged sectional view of portions of the restorable fender panel of the present invention taken along the line 3—3 of FIG. 2.

It is a particular feature of the present invention that the fender panels 32 are self restoring. Helical springs 76 are pivotally mounted by suitable fasteners such as, for example, lag type screw eyes 78 and 80 to the fender panel and to the diaphragm member 24 to which the fender panel 32 is coupled, as shown in FIGS. 2 and 3. The helical spring 76 biases the fender panel 32 laterally inward against the adjacent and rearward fender panel 32 which is overlapped.

Preferably, the helical springs 76 are stainless steel extension springs so as to avoid corrosion and allow a long extension without permanent deformation. The helical springs 76 are particularly effective when bridging the associated fender panels 32 and diaphragm members 24 to form an approximate isosceles triangle, as shown. In the preferred embodiment, the helical springs extend horizontally at the base of an isosceles triangle having sides of a length of 4 11/16 inches formed by the fender panels 32 and the diaphragm member 24. This spacing permits the helical spring 76 to be laterally outward of the array of the buffer elements 14, thereby avoiding interference with the buffer elements.

The material and dimensions of the helical springs 76 are, of course, dependent upon the size of the impact attenuation device 10 and the size and speed of the vehicles anticipated. For a typical installation, Applicant has found that the helical springs 76 may be No. E1125-105-6500-5 as supplied by Associated Spring Corporation of Simsbury, Conn. Such springs have a coil diameter of 1⅛ inches (28.58 mm), a wire diameter of 0.105 inches (2.67 mm), an unextended length of 6.5 inches (165.1 mm), a maximum extension of 15.2 inches (386.59 mm), and a spring rate of 3.9 pounds per inch (0.683 Newtons per mm).

In addition to the helical springs 76, the fender panels 32 are held laterally inward in their normal positions by wire clips 82 which are fixed to the fender panels 32 by hex head lag screws 84. The wire clips 82 are simply formed of wire so as to have a loop at one end for receiving the lag screws 84 and a free end which is wrapped around the upper one of the pullout cables 66. The wire for the wire clips 82 is selected such that the wire is easily bent during set up or servicing of the impact attenuation device 10 but such that the pullout cables will be released by the wire clips in the event of particular types of impact. The preferred wire is No. 10 (0.135 inches or 3.43 mm diameter) galvanized per Federal Specification QQW 461.

Figure 5:
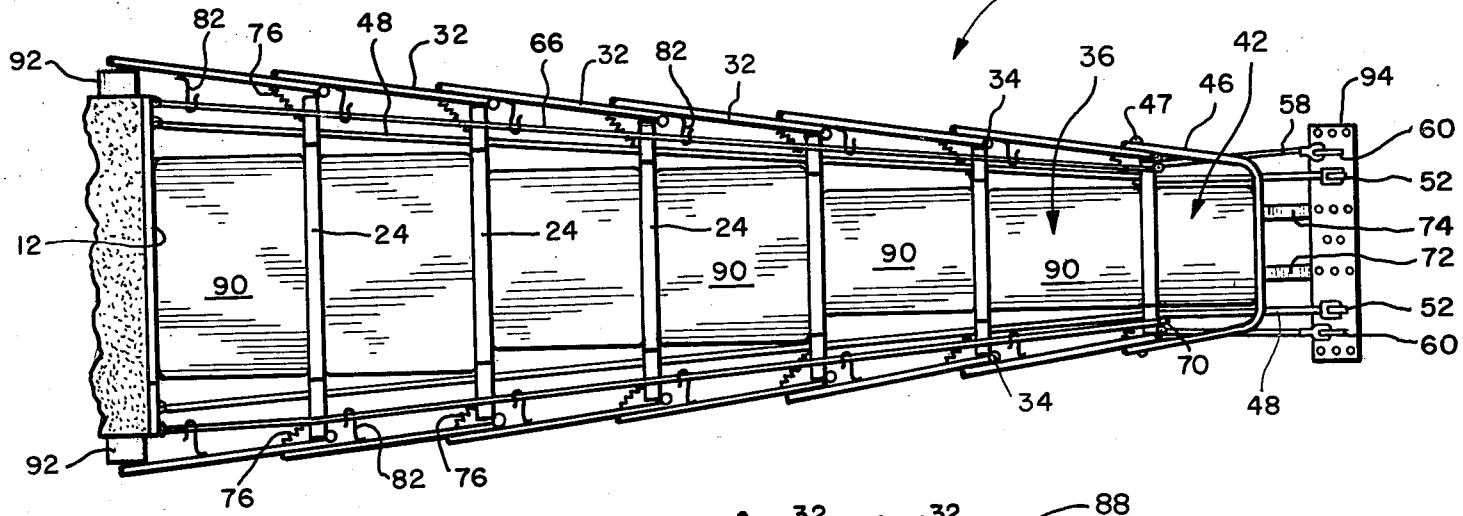
FIG. 5 is a plan view of a second impact attenuation device having a restorable fender panel made in accordance with the present invention before an impact.

The restorable fender panel of the present invention is not limited to use with the first impact attenuation device 10, having liquid filled buffer elements 14, as shown in FIGS. 1 and 2. In addition, the restorable fender panel may be used with a second impact attenuation device 88, having dry buffer elements 90 and 92, as shown in FIG. 5. The buffer elements 90 and 92 include expanded mica cells which are wrapped with wire and asphalt coated foil as described in U.S. Pat. No. 3,666,055. The mica cells crush on impact allowing the buffer elements 90 and 92 to compress as they absorb and dissipate energy. The wire wrapping serves to regulate the collapsing of the buffer elements 90 and 92 in a manner analogous to the operation of the orifices of the first impact attenuation device 10.

OPERATION OF THE PREFERRED EMBODIMENT

Figure 6:
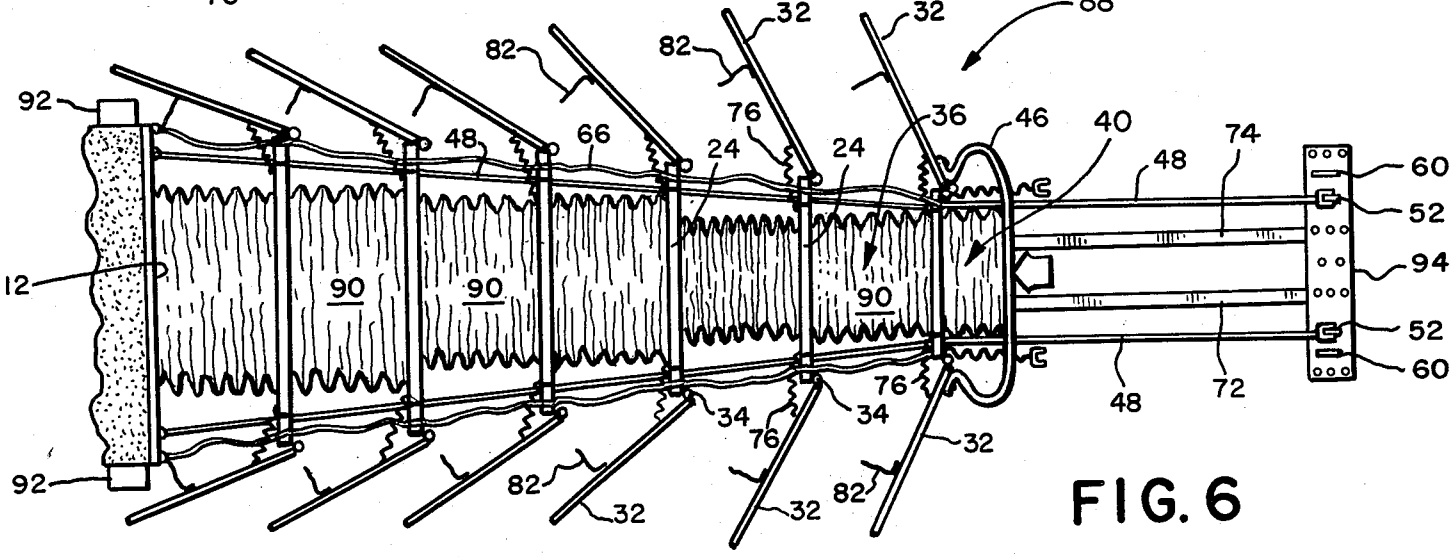
FIG. 6 is a plan view of the impact attenuation device of FIG. 5 during an impact directed against the front of the impact attenuation device.

A vehicle impacting the first impact attenuation device 10 may first contact and compress the forward cluster 42 located ahead of the forwardmost of the diaphragm members 24. Due to the low position of the anchor plate 54, the vehicle passes over the anchor plate 54 without impact. A portion of the impact energy of the moving vehicle is then absorbed and dissipated by the regulated flow of fluid from the buffer elements 14 of the forward cluster 42 through the orifices of the cell inserts 16. FIGS. 5 and 6 show the second impact attenuation device 88 before and during such an impact.

As the vehicle continues, the forward cluster 42 is forced rearward, and the remaining impact energy is transferred to the forwardmost of the diaphragm members 24, which slides rearward on the slide straps 72 and 74 and compresses the buffer elements 14 within the chamber behind the forwardmost diaphragm member. A further portion of the energy of impact is absorbed and dissipated by the buffer elements 14 as fluid in those elements is discharged through the orifices at a rate commensurate with the impact force. The diaphragm members 24 and the interior panels 22 serve to uniformly distribute the force of impact between the buffer elements 14 within each of the rows 20. As the buffer elements 14 of that chamber are compressed, a force is applied to the succeeding one of the diaphragm members 24, which moves along the slide straps 72 and 74 and applies a compressive force to the succeeding chamber of the buffer elements 14.

The energy absorption and dissipating process described above is repeated successively, with the remaining force of impact being transmitted to the succeeding adjacent one of the diaphragm members 24. The heavier the vehicle and the greater its speed, the greater the number of successive diaphragm movements which will be required to dissipate the kinetic energy and bring the vehicle to a stop. Since each of the diaphragm members 24 is successively wider than the preceding one, a stepped or telescoped effect is provided. The larger mass of the row of the buffer elements 14 and of the interior panels 22 associated with the larger diaphragm members 24 nearer the backing member 12 gives the rear portion of the buffer device 10 a higher degree of energy absorbing capability. Therefore, as the vehicle moves toward the backing member 12, the resistive forces acting to bring the vehicle to a halt increase.

The fender panels 32 swing outwardly on the hinges 34 against the biasing of the helical springs 76 in response to the movement of the diaphragm members 24 toward each other and the inertia of the fender panels 32 themselves. The wire clips 82 are straightened sufficiently during the impact to release the fender panels 32, as shown in FIG. 6. The outward movement of the fender panels requires an expenditure of energy and thereby assists the device in further slowing the vehicle. As the diaphragm members 24 move toward each other while compressing the buffer elements 14 during impact, the restraining cables 48 control the movement of the diaphragm members 24 and prevent the impact attenuation device 10 from buckling in the lateral and vertical directions. The secondary cables 58 are broken loose from the smaller mounting brackets 60 of the anchor plate 54 upon impact. After the impact, the fender panels 32 are returned to their normal positions by the biasing of the springs 76.

The impact attenuation device 10 is also effective in redirecting a side angle impact. The force of the impacting vehicle causes the fender panels 32 on the impacted side of the impact attenuation device 10 to remain in an inward position and act as fenders to deflect the vehicle away from the impact attenuation device 10. Instead of directing the vehicle into the lane of oncoming traffic, the vehicle is effectively fendered away in a direction substantially parallel to the impact attenuation device 10.

The restraining cables 40 resist lateral movement yet yield sufficiently to reduce the force of impact reacting against the vehicle. The low coefficient of friction of the outer surface of the fender panels 32 enables the vehicle to slide easily along the fender panels 32 following impact. The amount of penetration of the vehicle into the impact attenuation device 10 is small, and, since the frictional force developed between the vehicle and the fender panels 32 is relatively small, the vehicle is redirected and does not "pocket" and spin out. The pullout cables 66 prevent movement of the diaphragm members 24 away from each other and thereby maintain pressure on the buffer elements 14 during a side angle impact.

From the foregoing, it should be apparent that in improved restorable fender panel for a reusable impact attenuation device has been disclosed. The particular fender panel of the present invention is held laterally inward in the normal position so as to eliminate flapping of the fender panel before an impact and is released during an impact to absorb and dissipate energy. The fender panel is restored to the normal position after an impact even if the chambers of the buffer elements have collapsed placing the diaphragm members closer together. The fender panel is economical, convenient to set up and service, and provides improved operation of the impact attenuation device if a second impact occurs before the impact attenuation device is serviced.

Of course, it should be understood that various changes and modifications to the preferred embodiment described will be apparent to those skilled in the art. For example, other biasing means having a different configuration could be used in place of the helical springs described. Similarly, other mounting means for the biasing means could be employed. It is therefore intended that the foregoing detailed description be regarded as illustrative rather than limiting and that it be understood that it is the following claims, including all equivalents, that are intended to define the scope of this invention.

We claim:

1. A reusable impact attenuation device comprising:

a rigid backing member;

a plurality of buffer elements positioned in an ordered array extending forwardly of said backing member;

a plurality of diaphragm members interposed in said array at spaced intervals with the opposed ends of at least preselected ones of said diaphragm members extending laterally outward of said array;

a plurality of fender panel members pivotally coupled to opposed ends of selected diaphragm members, the panel members extending rearwardly from their associated diaphragm member and partially overlapping the panel member associated with the succeeding diaphragm member;

non-rigid means interconnecting said backing member and said diaphragm members;

said diaphragm members being constructed to telescope in response to an axial impact force;

said fender panel members being designed so that said overlapping portion of said fender panel member moves outwardly away from said overlapped panel member associated with said diaphragm member in response to an axial impact force; and biasing means for biasing said fender panels laterally inward to a pre-impact position abutting an associated fender panel and for causing said fender panels to move inwardly after an axial impact force to said pre-impact position, said biasing means interconnecting each of the fender panels to a diaphragm member.

2. The reusable impact attenuation device of claim 1 wherein the biasing means comprises a helical spring having a first end connected to the fender panel member and a second end connected to the diaphragm member to which the fender panel member is pivotally coupled.

3. The reusable impact attenuation device of claim 2 wherein the helical spring forms a substantially isosceles triangle with the diaphragm member and the fender panel member.

4. The reusable impact attenuation device of claim 3 wherein the helical spring is pivotally connected to the diaphragm member laterally outward of the array of buffer elements and the helical spring is substantially horizontal.

5. The reusable impact attenuation device of claim 2 wherein the helical spring is an extension spring made of stainless steel having a spring rate between 3 and 6 pounds per inch.

6. The reusable impact attenuation device of claim 1 including a releasable clip mounted upon each of the fender panel members engageable with the non-rigid means so as to releasably hold the fender panel member against the overlapped fender panel member coupled to the succeeding diaphragm member such that the wire clip restrains flapping of the fender panel members before an impact and such that the wire clip releases the fender panel member under certain impact conditions for absorbing and dissipating energy.

7. The reusable impact attenuation device of claim 6 wherein the non-rigid means comprises a cable stretched along the edges of the diaphragm members and the releasable clip comprises a wire bent at least partially around the cable and designed to straighten sufficiently during certain impact conditions to release the fender panel member from the cable.

* * * * *